US006230665B1

(12) United States Patent
Reynolds et al.

(10) Patent No.: US 6,230,665 B1
(45) Date of Patent: May 15, 2001

(54) FLAMMABLE VAPOR RESISTANT WATER HEATER

(75) Inventors: Gregory Allen Reynolds, Columbia; R. Dale Shropshire, Hartsville, both of SC (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 09/563,968

(22) Filed: May 3, 2000

Related U.S. Application Data

(62) Division of application No. 09/359,089, filed on Jul. 22, 1999, now Pat. No. 6,109,216.

(51) Int. Cl.[7] ..... F22B 5/00

(52) U.S. Cl. ..... 122/13.01; 122/18.5; 122/19.2; 122/494

(58) Field of Search ..... 122/13.01, 185, 122/19.2, 494; 126/350.1

(56) References Cited

U.S. PATENT DOCUMENTS

| | | | |
|---|---|---|---|
| 1,354,295 | | 9/1920 | Hamilton . |
| 1,634,889 | * | 7/1927 | Shuell ..... 122/19.2 |
| 1,689,935 | | 10/1928 | Shuell . |
| 1,692,839 | | 11/1928 | Humphrey . |
| 1,737,202 | | 11/1929 | Runnels . |
| 1,961,231 | * | 6/1934 | Maier ..... 122/13.01 |
| 2,499,636 | | 3/1950 | Finley . |
| 2,617,390 | | 11/1952 | Schueder et al. . |
| 2,720,851 | | 10/1955 | Strunsky . |
| 3,006,408 | | 10/1961 | Shepherd . |
| 3,091,223 | | 5/1963 | Vitale . |
| 3,110,302 | | 11/1963 | Buehl . |
| 3,124,108 | | 3/1964 | Wenczl . |
| 3,162,239 | | 12/1964 | Irons . |
| 3,163,159 | | 12/1964 | Buehl et al. . |
| 3,415,556 | | 12/1968 | Dryden . |
| 3,920,375 | | 11/1975 | Sanderson et al. . |
| 4,373,472 | | 2/1983 | Kreis . |
| 4,541,410 | | 9/1985 | Jatana . |
| 4,766,883 | | 8/1988 | Cameron et al. . |
| 4,919,609 | | 4/1990 | Sarkisian et al. . |
| 4,924,816 | | 5/1990 | Moore, Jr., et al. . |
| 5,001,017 | | 3/1991 | Alhamad et al. . |
| 5,018,748 | | 5/1991 | Schalle . |
| 5,020,512 | | 6/1991 | Vago et al. . |
| 5,022,352 | | 6/1991 | Osborne et al. . |
| 5,097,907 | | 3/1992 | Alhamad et al. . |
| 5,146,911 | | 9/1992 | Adams . |
| 5,154,140 | | 10/1992 | Windon . |
| 5,317,992 | | 6/1994 | Joyce . |
| 5,355,841 | | 10/1994 | Moore, Jr., et al. . |
| 5,402,852 | | 4/1995 | Alhamad et al. . |

(List continued on next page.)

FOREIGN PATENT DOCUMENTS

| | | |
|---|---|---|
| 1581702 | 9/1969 | (FR) . |
| 1557 | 5/1914 | (GB) . |
| 58-72818 | 5/1983 | (JP) . |

OTHER PUBLICATIONS

1952—MIT Fourth Symposium on Combustion.
1960 (Apr.); pp. 172–174, Coke and Gas, "Reports of the Industrial Gas Development Committee".
1963—Research Bulletin 97, Some New or Unusual Methods for Heating Water With Gas, J.C. Griffiths.

*Primary Examiner*—Jiping Lu
(74) *Attorney, Agent, or Firm*—Michael Best & Friedrich LLP

(57) ABSTRACT

A water heater including a water tank, a combustion chamber beneath the tank, a gas burner in the combustion chamber, an air plenum upstream of the combustion chamber, a flame arrestor located such that air in the air plenum passes through the flame arrestor to reach the combustion chamber, and a flue extending upwardly from the combustion chamber and through the water tank.

14 Claims, 9 Drawing Sheets

U.S. PATENT DOCUMENTS

| | | |
|---|---|---|
| 5,427,525 | 6/1995 | Shukla et al. . |
| 5,429,186 | 7/1995 | Kurz et al. . |
| 5,494,033 | 2/1996 | Bartz et al. . |
| 5,501,472 | 3/1996 | Brancher et al. . |
| 5,511,516 | 4/1996 | Moore, Jr. et al. . |
| 5,687,678 | 11/1997 | Suchomel et al. . |
| 5,697,330 | 12/1997 | Yetman et al. . |
| 5,791,298 | 8/1998 | Rodgers . |
| 5,794,707 | 8/1998 | Alhamad . |
| 5,797,355 | 8/1998 | Bourke et al. . |
| 5,826,569 | 10/1998 | Voorhis . |
| 5,941,200 | 8/1999 | Boros et al. . |
| 5,950,573 | 9/1999 | Shellenberger et al. . |
| 6,003,477 | 12/1999 | Valcic . |

* cited by examiner 10
12
14
16
18
38
40
42
46
48
50
54
58
62
66
70
74
74a
74b
78
82
84
86
90
92
94
96
98
100
102
104
106
114
116
122
126
138
142
144
150
158
162
164
166

12
54
200
82
202
18
16
14
10
42
114
50
44
38
46
48
62
74
70
66
78
58
96
94
84
86
98
90

Fig. 15
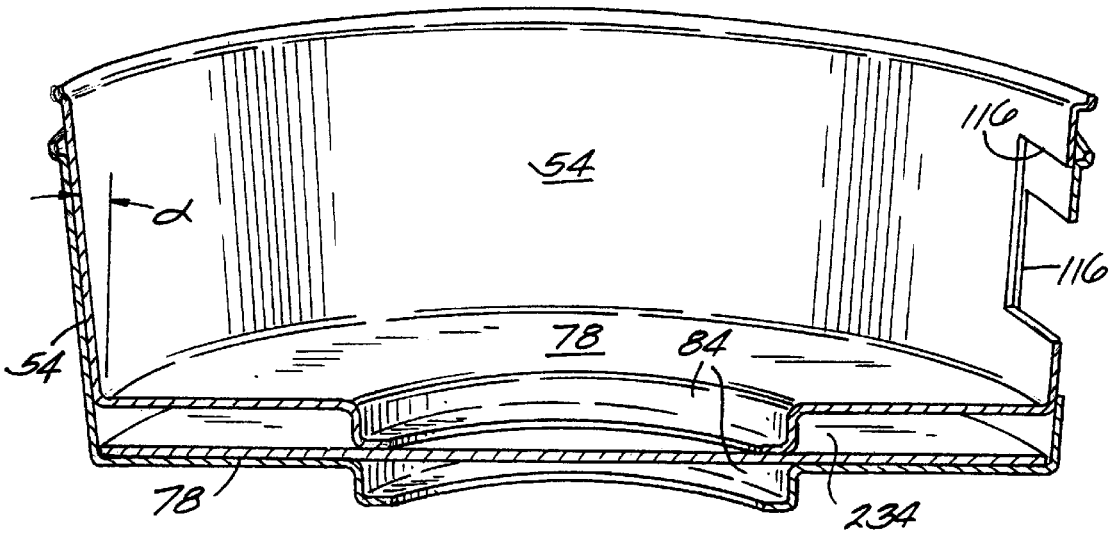
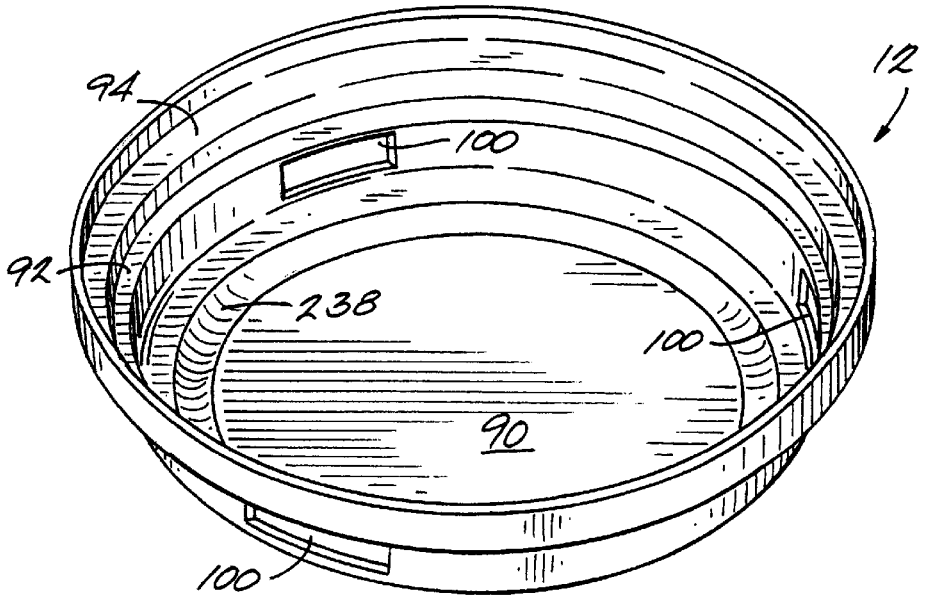
Fig. 16

FLAMMABLE VAPOR RESISTANT WATER HEATER

This application is a divisional application of U.S. application Ser. No. 09/359,089, filed Jul. 22, 1999. Now U.S. Pat. No. 6,109,216.

FIELD OF THE INVENTION

The invention relates to water heaters. More particularly, the invention relates to flammable vapor resistant gas water heaters.

BACKGROUND

Gas-fired, storage-type water heaters often include a combustion chamber and air plenum disposed below a water tank. A burner element, gas manifold tube, ignition source, thermocouple, and a pilot tube typically extend into the combustion chamber. When the temperature of the water in the tank falls below a set minimum, gas fuel is introduced into the combustion chamber through the gas manifold tube and burner element. This gas fuel is ignited by the pilot flame or other ignition source, and the flame is maintained around the burner element. Air is drawn into the plenum, and mixes with gas fuel to support combustion within the combustion chamber. The products of combustion typically flow through a flue or heat exchange tube in the water tank to heat the water by convection and conduction.

In some cases, a water heater may be positioned in an area that is also occupied by lawnmowers, chain saws, snow blowers, trimmers, and other equipment having a gasoline-powered internal combustion engine. In such cases, it is not uncommon that there be gasoline and other flammable substances (e.g., kerosene, diesel, turpentine, solvents, alcohol, propane, methane, and butane) present in the same area. Such flammable substances often emit flammable vapors.

If the flammable substances are mishandled, the flammable vapors may encounter an ignition source, such as the pilot flame or burner flame of a gas-fired water heater. As a result of the mishandling of flammable substances, the flammable vapors may ignite, and the flame may follow the flammable vapors to their source, causing an explosion and/or a fire. Proposed governmental regulations would require residential gas-fired water heaters to be flammable vapor resistant in order to help reduce the occurrence of such dangerous situations caused by the mishandling of flammable substances.

SUMMARY

The present invention provides a water heater having a flame arrestor or flame trap. The water heater also includes a water tank, a combustion chamber, an air plenum, and a burner element in the combustion chamber. The burner element supports continuous combustion within the combustion chamber during heating of the water in the water tank. A radiation shield preferably helps to maintain heat within the combustion chamber and direct the heat toward the bottom of the water tank.

The invention requires substantially all air that is necessary for combustion to pass through the flame arrestor. When flammable vapors are mixed with the combustion air, the flammable vapors may be ignited and burned near the surface of the flame arrestor facing the combustion chamber. The flammable vapors burn until the flammable vapor mixture no longer supports combustion. The arrestor is designed such that it will not significantly deteriorate during the burning of the flammable vapors or over the life of the water heater. The flame arrestor is designed to have an air-flow path that substantially prevents flames from traveling through the flame arrestor. The arrestor is constructed of materials having low thermal conductivity so that the flame arrestor itself is not likely to become an ignition source for the flammable vapors. The flame arrestor is also designed to accommodate a wide variety of possible flammable vapor mixtures.

A retainer member holds the flame arrestor in place. Preferably, the retainer member includes a portion that helps provide a seal around the periphery of the flame arrestor so that substantially all air entering the combustion chamber must pass through the flame arrestor. Thus, substantially all flash-back that may occur due to flammable vapors entering the combustion chamber is quenched or arrested within the combustion chamber by the flame arrestor. A portion of the retainer member passes through a portion of the radiation shield. The portion of the retainer member preferably includes a protrusion that resists vertical movement of the radiation shield. Thus, the radiation shield is located and held in place within the combustion chamber by the retainer member. The retainer member may also support the burner tube or manifold tube and the burner element within the combustion chamber.

Another feature of the present invention is a screen that covers the air inlet of the air plenum. The screen traps airborne debris that would otherwise enter the air plenum and be trapped by the flame arrestor. This substantially prevents a buildup of such debris on the flame arrestor that could interfere with the flow of air through the flame arrestor, and that could cause flare-ups on the surface of the flame arrestor facing into the air plenum. The screen may therefore reduce or eliminate the need for servicing the flame arrestor.

The screen includes a protrusion that prevents air flow across the air inlet that might cause a partial vacuum and interfere with combustion. The screen protrusion may include a double-thick portion of screen material, to create a substantially dead-air region on the lee of the protrusion. The protrusion also serves to deflect at least some of the cross-flowing air into the air plenum. This may result in more reliable and efficient water heater performance.

The water heater preferably includes a one-piece base pan that includes a first level defining a bottom wall of the combustion chamber/plenum, a second level that supports the water tank, and a third level that supports the water heater insulation and outer jacket surrounding the water tank. The single-piece base pan thus serves several functions that are performed by separate components in known water heaters. The use of a single component to perform several functions may reduce the cost and complexity of manufacturing the water heater.

The water heater may also include a sealing member, such as a grommet or boot, that surrounds a burner operating conduit, such as the gas manifold tube, pilot light tube, ignition wire, or thermocouple. The sealing member creates a substantially airtight seal between the burner operating conduit and the side wall of the water heater. Preferably, a single grommet seals several burner operating conduits with respect to the side wall, and a boot seals the gas manifold tube with respect to the side wall. The boot may include a plurality of folds to permit some movement of the gas manifold tube with respect to the skirt without compromising the substantially airtight seal. Both the grommet and the boot may include a peripheral groove that permits them to be easily snapped into place within openings in the skirt.

Other features and advantages of the invention will become apparent to those skilled in the art upon review of the following detailed description, claims, and drawings.

BRIEF DESCRIPTION OF THE DRAWINGS

FIG. 15 is a cross-section view of the skirt and flame arrestor support stacked inside another skirt and flame arrestor support.

FIG. 16 is a perspective view of an alternative base pan.

Figure 4:
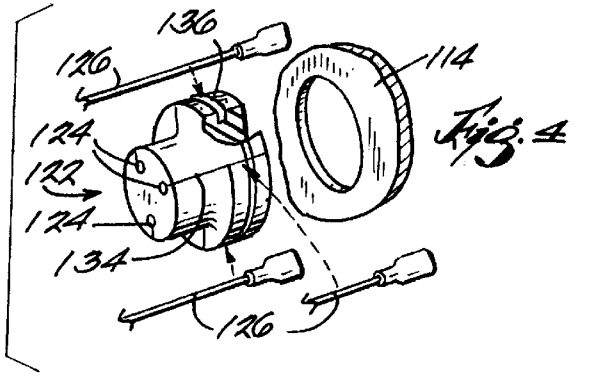
FIG. 4 is an exploded view of the grommet.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items

DETAILED DESCRIPTION

Figure 1:
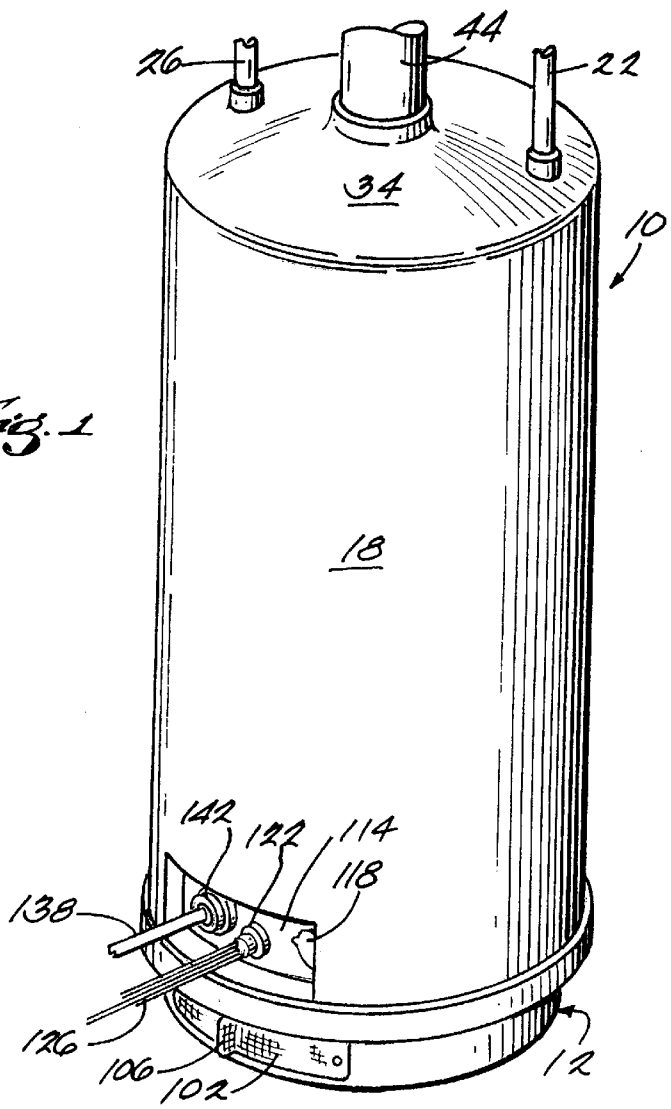
FIG. 1 is a perspective view of a water heater embodying the present invention.

FIG. 1 illustrates a storage-type gas-fired water heater 10 including a base pan 12 supporting a water tank 14 (FIG. 2), insulation 16 surrounding the tank 14, and an outer jacket 18 surrounding the insulation 16 and the water tank 14. The base pan 12 may be constructed of stamped metal or plastic. A cold water inlet tube 22 and a hot water outlet tube 26 extend through a top wall 34 of the water tank 14.

Figure 3:
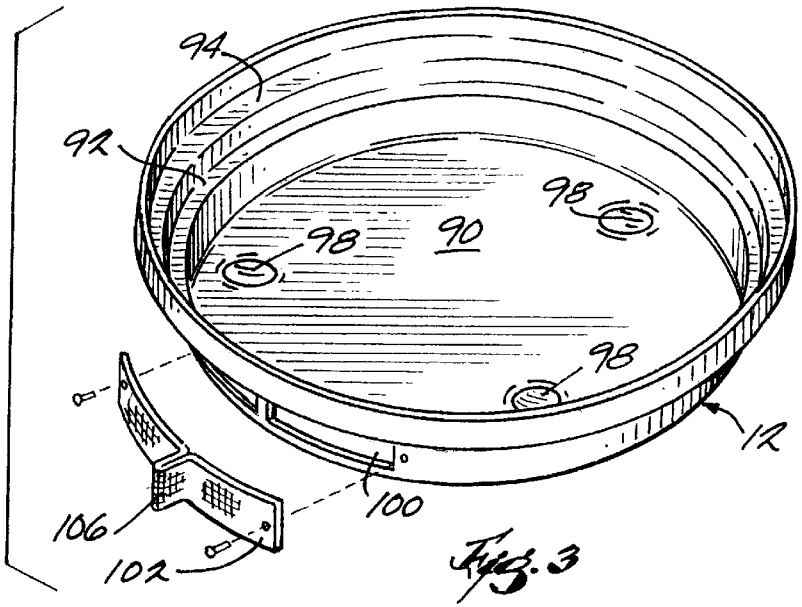
FIG. 3 is an exploded view of the base pan and screen.
Figure 2:
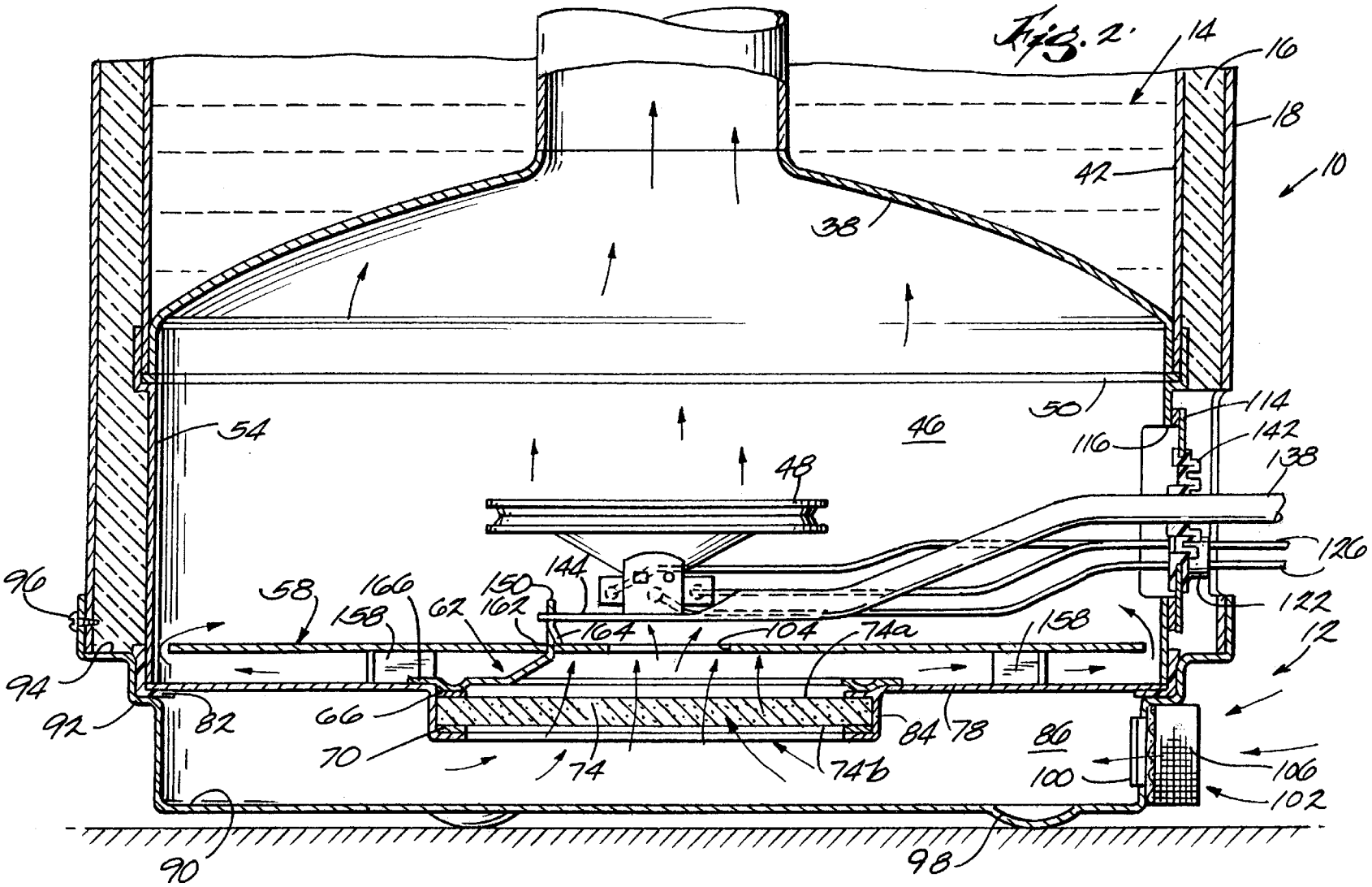
FIG. 2 is a cross-section view of the bottom portion of the water heater.
Figure 7:
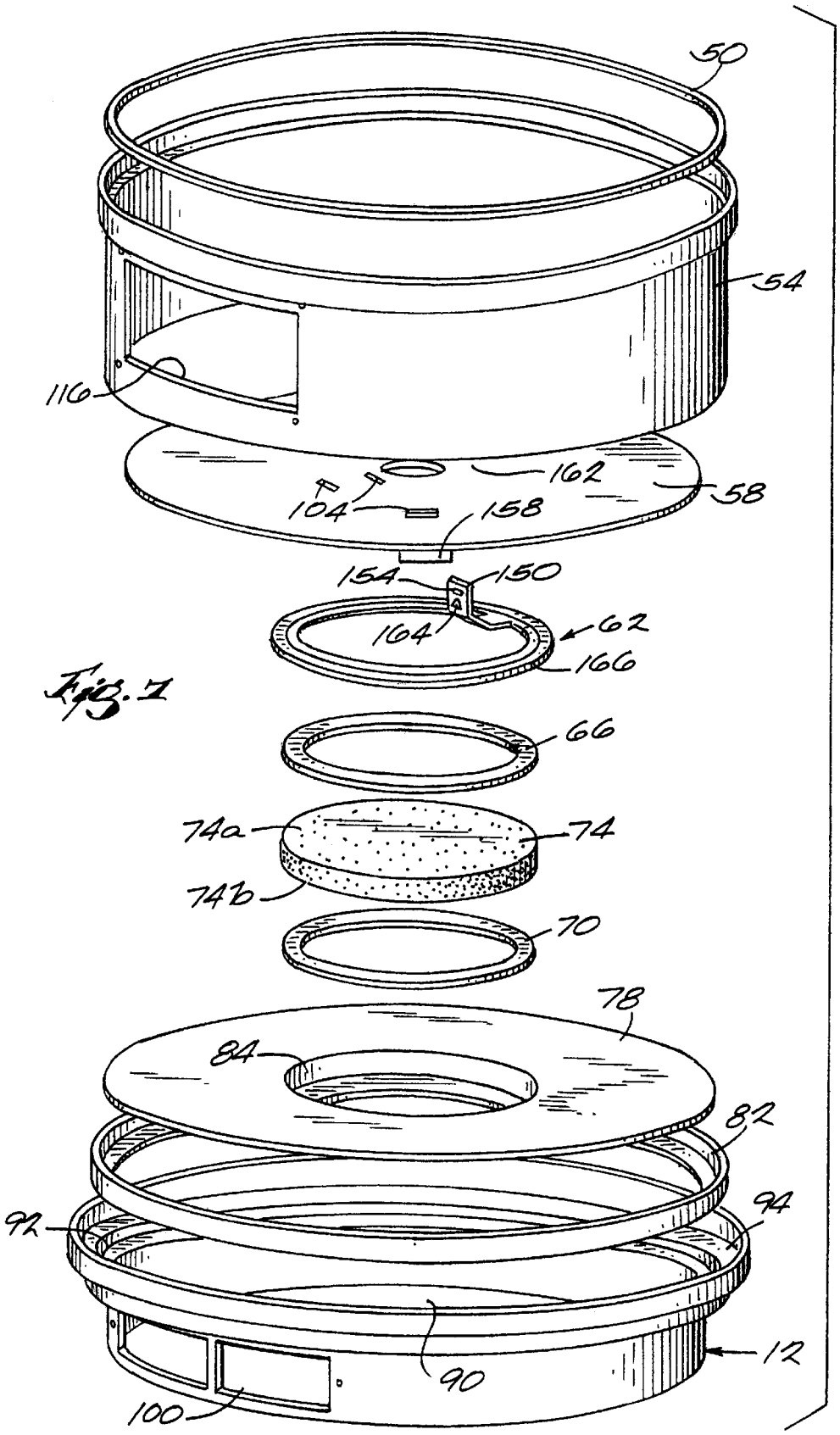
FIG. 7 is an exploded view of the lower portion of the water heater.

FIGS. 2, 3, and 7 best illustrate the bottom of the water heater 10. The tank 14 is defined by a tank bottom wall 38 and side wall 42, and the top wall 34. A flue 44 extends from the tank bottom wall 38 up through the tank portion 14 of the water heater 10. The water contained in the tank 14 surrounds the flue 44.

The bottom of the water heater 10 defines a combustion chamber 46 having therein a conventional gas burner 48. The water heater 10 includes a seal 50, a skirt 54, a radiation shield 58, a retainer member 62, first and second flame arrestor seals 66, 70, a flame arrestor 74, an inner plate or flame arrestor support 78, and a plenum seal 82. Optionally, the skirt 54 and flame arrestor support 78 may be formed as one piece, as discussed below.

The flame arrestor 74 is disposed within a recessed portion 84 of the flame arrestor support 78. The flame arrestor seals 66, 70 are disposed above and below the flame arrestor 74 to provide a seal between the flame arrestor 74 and the retainer member 62 and flame arrestor support 78. Alternatively, only one of the first and second seals 66, 70 may be used without the other seal so long as a quality seal is provided between the flame arrestor support 78 and the flame arrestor 74. The flame arrestor 74 has an upper surface 74*a* and a lower surface 74*b*. The flame arrestor 74 permits substantially all flammable vapors that are within flammability limits to burn near its top surface 74*a* while preventing substantially all flames from passing from the top surface 74*a*, through the flame arrestor 74, out the bottom surface 74*b*, and into the plenum 86. The flame arrestor 74 is constructed of materials that resist thermal conduction from the upper surface 74*a* to the lower surface 74*b* to further reduce the likelihood of ignition of flammable vapors in the air plenum 86.

There are a number of forms that the flame arrestor 74 may take. For example, the flame arrestor 74 may have through-holes or a random pattern of interconnected voids. A conglomeration of randomly-oriented fibers or particles may form the random pattern of interconnected voids. The air that is necessary for combustion of the gaseous fuel during normal operation of the water heater 10 is allowed to flow from void to void from the bottom surface 74*b* to the top surface 74*a* of the flame arrestor 74. The arduous air-flow path through the flame arrestor 74 reduces the thermal conductivity of the flame arrestor 74, and substantially ensures that the bottom surface 74*b* of the flame arrestor 74 will be below the ignition temperature of the flammable vapors entering the flame arrestor 74, even when vapors are burning on the top surface 74*a* of the flame arrestor 74.

Preferably, the flame arrestor 74 is constructed of a matrix of particles or fibers (e.g., carbon or glass fibers) that are bonded or compressed together to form a cohesive unit. The size and shape of the particles or fibers are selected so that a random grouping of particles or fibers does no create a chain of voids that would allow a flame to travel through the flame arrestor 74. On the other hand, the size and shape of the particles or fibers is selected to avoid the isolation of a significant number of voids from other voids, which would effectively increasing the density of the flame arrestor 74 and unduly restrict the air flow through the flame arrestor 74. Alternatively, the flame arrestor 74 may be constructed of wire mesh, ceramic material, or any other suitable material.

The base pan 12 is best illustrated in FIG. 2. The base pan 12 is configured to provide the primary structural support for the rest of the water heater 10. Elevated temperatures and heat cycling do not compromise the structural stability of the materials from which the base pan 12 is constructed.

The base pan 12 includes a generally horizontal bottom wall 90, a first step 92, and a second step 94. The first step 92 is above and surrounds the bottom wall 90, and performs the function of a conventional base ring or base legs by supporting the weight of the water tank 14 through the skirt 54. The plenum seal member 82, which may be made of fiberglass or another suitable material, creates a substantially airtight seal between the flame arrestor support 78 and the base pan 12. The second step 94 is above and surrounds the first step 92, and supports the insulation 16 and the jacket 18, and therefore eliminates the need for a jacket base that is separate from the base pan 12. The base pan 12 may be attached to the jacket 18 with screws 96. The screws 96 may be either set screws that do not penetrate the jacket 18, or sheet metal screws as illustrated.

The weight of the water tank 14 is transferred through the base pan 12 to dimples 98 on the bottom of the base pan 12. The dimples 98 may be replaced with a formed ring in the bottom of the pan 12 as described below, or by any other suitable supporting structure. The dimples 98 reduce the amount of surface contact between the base pan 12 and the floor to inhibit the formation of rust. The dimples 98 are designed to retain the overall structural stability of the water heater 10 when compared to prior art water heaters. Three dimples 98 are illustrated, but more may be used in alternative embodiments.

The base pan 12 and the flame arrestor support 78 together define the air plenum 86. The base pan 12 includes an air intake aperture or air inlet 100 to the air plenum 86. The air inlet 100 is covered by a screen 102 (FIG. 3). The screen 102 is positioned upstream of the flame arrestor 74, and is made of a wire mesh material that acts as a lint or bug screen so that undesired objects or particles are not allowed to enter the plenum 86 leading to the combustion space 46. The illustrated screen 102 is located on the front side of the water heater 10 to facilitate cleaning. The location provides high visibility and reminds operators not to block the air inlet 100, and to inspect or clean the screen 102 whenever other components of the water heater 10 are adjusted.

The base pan 12 has preformed screw holes for attaching the screen 102 with fasteners. Because the screen 102 is upstream of the flame arrestor 74, the flame arrestor 74 will not collect as much debris as it would without the presence of the screen 102. The screen 102 filters the great majority of airborne particles that may interfere with the operation of the flame arrestor 74. Without the screen 102, particles would accumulate on the flame arrestor 74, and could possibly cause flare-ups on the bottom surface 74*b* if the debris caught fire. Such buildup in debris could also restrict the amount of air flowing through the flame arrestor 74, thereby interfering with combustion.

As indicated by the arrows in FIG. 2, air flows through the screen 102, into the plenum 86, through the flame arrestor 74, and around the radiation shield 58 or through apertures 104 in the radiation shield 58 (see also FIG. 7). Substantially all of the air that is necessary for combustion must pass through the flame arrestor 74. The hot products of combustion rise up through the flue 44, and heat the water by convection and conduction through the flue 44.

Figure 6:
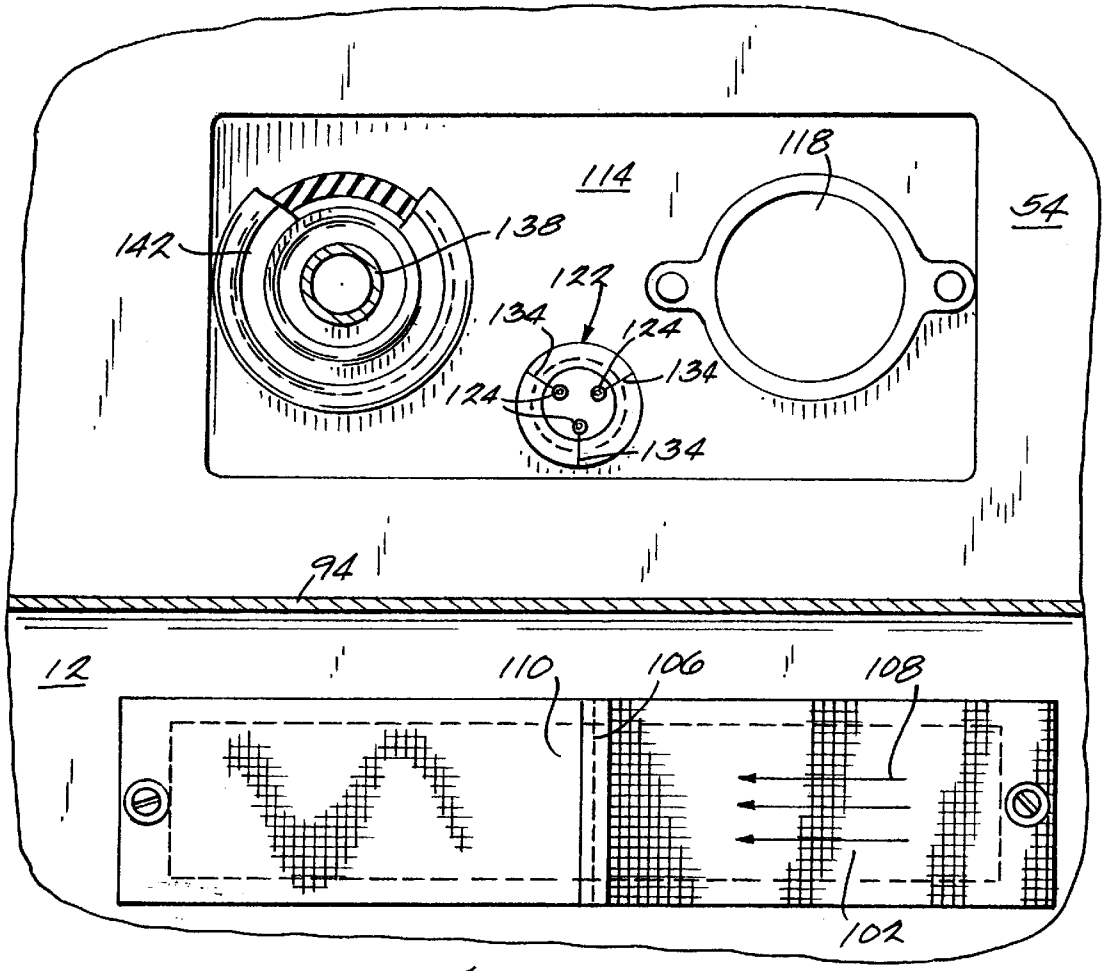
FIG. 6 is a view taken along line 6—6 in FIG. 5.
Figure 5:
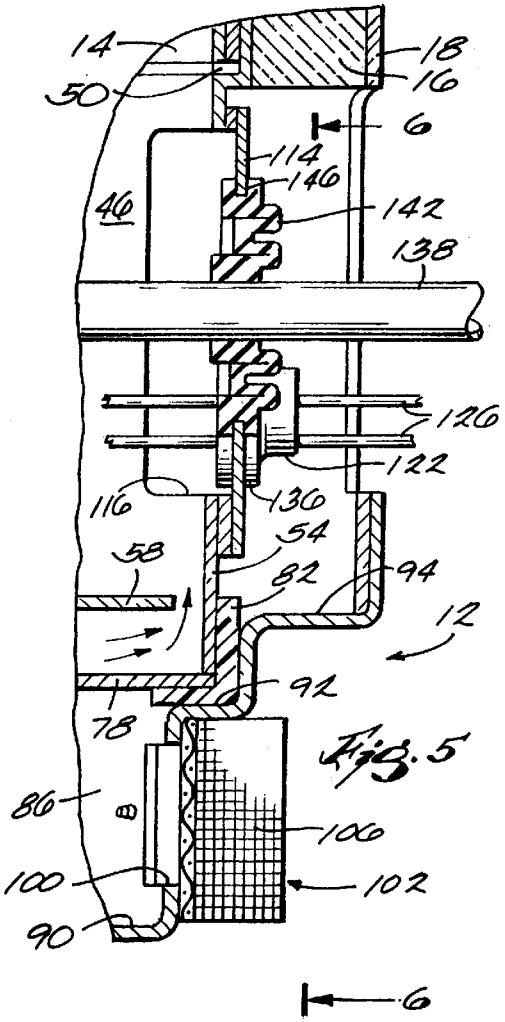
FIG. 5 is an enlarged view of a portion of the bottom of the water heater.

The screen 102 includes a tab 106 that extends radially outwardly from the base pan 12 side wall. The tab 106 is formed (see FIG. 3) by folding the wire mesh material in the illustrated embodiment, and is therefore a double-thick wire mesh screen. As shown in FIG. 6, the tab 106 slows down any flow of air 108 passing across the air inlet 100, such that a substantially dead air region is created on the lee 110 of the tab 106. By slowing down the air flowing across the air inlet 100, the tab 106 helps prevent or reduce any vacuum that might otherwise be created across the air inlet 100. The tab 106 also acts as a diverter, at least partially deflecting some of the cross-flowing air into the plenum 86. The tab 106 thus helps reduce or prevent the negative effects that cross-flowing drafts may have on combustion.

Alternatively, the tab 106 may be a separate piece that is attached to the screen 102, and may be solid or wire mesh, for example. If the tab 106 is a separate piece made of wire mesh, the mesh density of the tab 106 may be specifically selected for the purpose of slowing down cross-flowing air 108, as described above. The mesh density of the tab 106 may be selected such that the tab 106 serves this purpose without being a doubled-over wire screen. Other alternative configurations for the tab 106 may include angling the tab 106 with respect to the screen 102 to better deflect air into the air plenum 86. For example, the tab 106 may be a V-shaped piece, with the bottom of the "V" attached to the screen 102. Such a V-shaped tab may enhance the air-deflecting aspect of the tab 106 for air flowing from either side direction.

Referring to FIGS. 1 and 2, the seal 50, which may be an O-ring, provides an airtight seal between the top of the skirt 54 and the bottom wall 38 of the water tank 14. The skirt 54 includes an inner door or access door 114 covering an access opening 116. The access door 114 includes (see FIG. 6) three apertures. The first aperture accommodates a sight glass 118 that is made of a transparent material to permit viewing of the pilot light. The door 114 is generally curved to follow the curvature of the skirt 54. The first aperture is preferably stamped into the door 114 to create a substantially flat surface against which the sight glass 118 is held.

Referring to FIGS. 1 and 4–6, a grommet 122 is disposed within the second aperture and has channels or holes 124 through which various burner operating conduits, such as wires and tubes 126 (e.g., an ignition wire, a thermocouple lead, and a pilot light tube) extend so that the grommet 122 seals these components to the door 114. The grommet 122 is made of a material that will not degrade when exposed to elevated temperatures or cyclical heating. The grommet 122 has slits 134 extending from the holes 124 to an outer edge of the grommet 122 so that the wires and tubes 126 may be inserted into respective openings 124 via respective slits 134. In another embodiment (not shown), the grommet 122 would be assembled with the wires and tubes 126 in place so that the slits 134 would not be necessary. For example, the grommet 122 could be molded around the components 126. The grommet 122 is designed with a peripheral or circumferential groove 136 to snap into place in the access door 114 during assembly.

A gas manifold tube 138 extends through the third aperture. A boot 142 surrounds a portion of the manifold tube 138 and forms a substantially airtight compression seal around the manifold tube 138, and between the manifold tube 138 and the access door 114. The manifold tube 138 includes a flattened end 144 (FIG. 2) that extends adjacent to the burner 48, and supplies gas fuel to the burner 48. The boot 142 includes a plurality of folds that create an undulating surface and allow the manifold tube 138 to move with respect to the access door 114, while maintaining the airtight seal. The boot 142 includes a peripheral groove 146 (FIG. 5) that receives an edge defining the third aperture to seal the boot 142 to the inner door 114 or some other surface that is penetrated.

The undulating surface of the boot 142 allows the manifold tube 138 to be positioned in a location relative to the hole in the inner door 114 or combustion chamber 46 that is within an acceptable tolerance range. The substantially airtight seal around the combustion chamber 46 is not compromised by this design. The boot 142 is constructed of material that is flexible enough to allow the manifold tube 138 to position itself as it penetrates the wall of the combustion chamber 46. The material must also resist degradation when exposed to elevated temperatures and heat cycling over the life span of the water heater 10.

Referring now to FIG. 2, the retainer member 62 performs a number of functions, including supporting the burner 48 in the operating position shown, positioning the radiation shield 58 in the operating position shown, holding the flame arrestor 74 in the operating position shown, and locating the flattened end 144 of the manifold tube 138 in the operating position shown. The retainer 62 has an upwardly-extending projection or portion 150. The flattened end 144 of the tube 138 is inserted into a slot 154 (FIG. 7) in the portion 150.

The radiation shield 58 includes a plurality of feet 158 (see FIGS. 2 and 7) that contact the flame arrestor support 78 and support the radiation shield 58 above the flame arrestor support 78 to permit the air flowing through the flame arrestor 74 to flow between the flame arrestor support 78 and the radiation shield 58, or through the apertures 104 before reaching the burner 48. Alternatively, the skirt 54 may include projections which support the radiation shield 58 above the flame arrestor support 78. The retainer member projection or portion 150 extends upwardly through a slot 162 in the radiation shield 58, and has thereon a dimple or protrusion 164 that contacts the upper surface of the radiation shield 58 and resists vertical movement of the shield 58. The portion 150 holds the shield 58 in a generally centered location with respect to the combustion chamber 46.

A ring portion 166 of the retainer member 62 includes a downwardly-facing convex surface that compresses the seals 66, 70 so that a quality seal may be achieved. The ring portion 166 may be tack or spot welded to the flame arrestor support 78 to hold the flame arrestor 74 in place and resist the flow of air around the edge of the flame arrestor 74. Alternatively, the retainer member 62 may be releasably fastened to the flame arrestor support 78 such that the flame arrestor 74 is more easily serviceable.

It should be noted that the position and orientation of the flame arrestor 74 is not limited to those shown in the drawings. The flame arrestor 74 may be positioned anywhere and in an orientation, provided the screen 102 is upstream of the flame arrestor 74, and, preferably, an air plenum 86 is disposed between the flame arrestor 74 and screen 102.

Figures 8, 9:
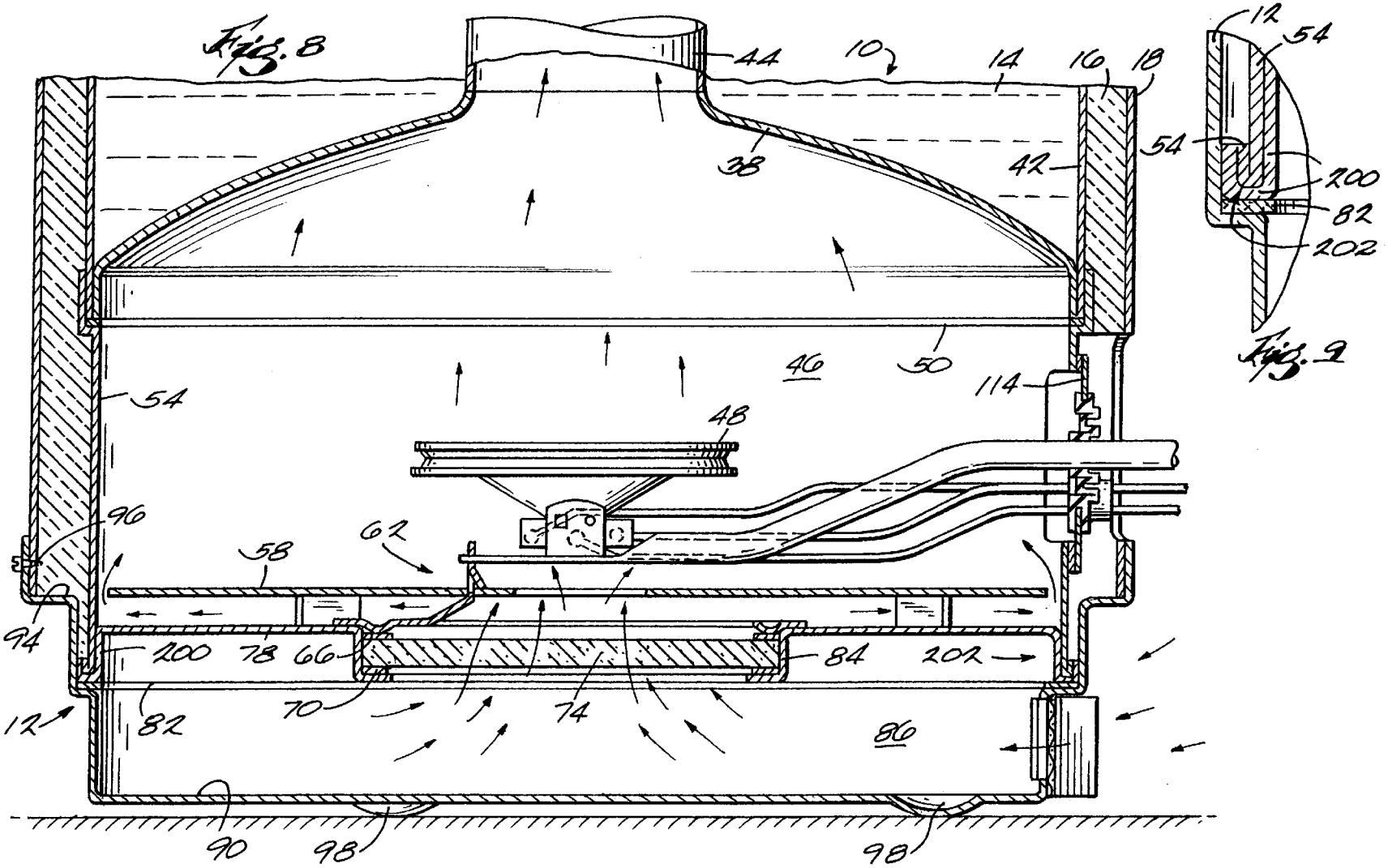
FIG. 8 is an enlarged view of an alternative embodiment of the lower portion of the water heater.
FIG. 9 is an enlarged view of a portion of the water heater shown in FIG. 8.

FIGS. 8–16 illustrate alternative embodiments of the invention. FIGS. 8 and 9 illustrate an alternative flame arrestor support 78 that includes a peripheral depending wall 200. In this embodiment, the lower end of the wall 200 is folded over the lower end of the skirt 54, and bent about 180° to create a seam or hem 202. FIGS. 8 and 9 also illustrate an alternative plenum seal 82 that is generally flat.

Figure 10:
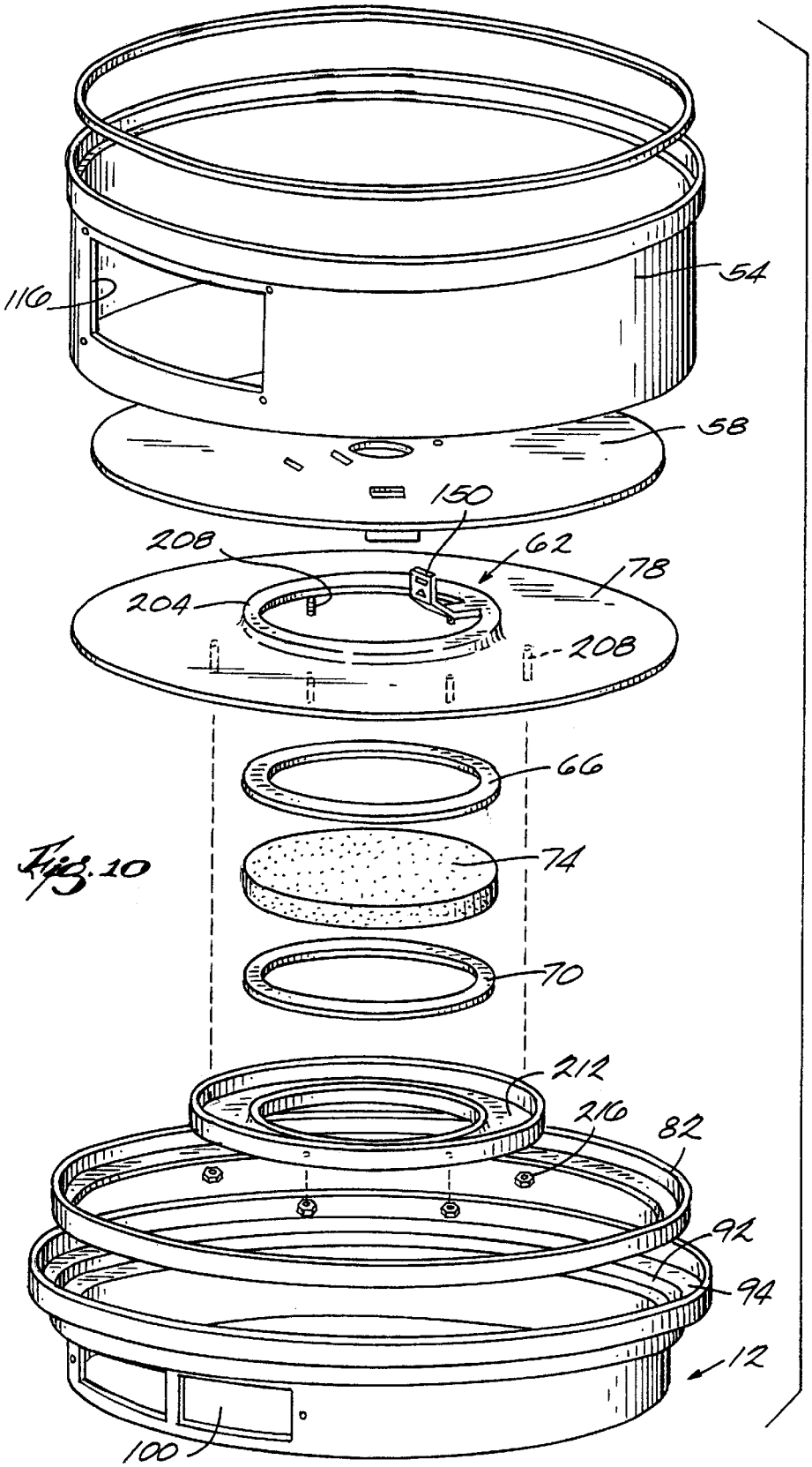
FIG. 10 is an exploded view of another alternative embodiment of the lower portion of the water heater.
Figure 11:
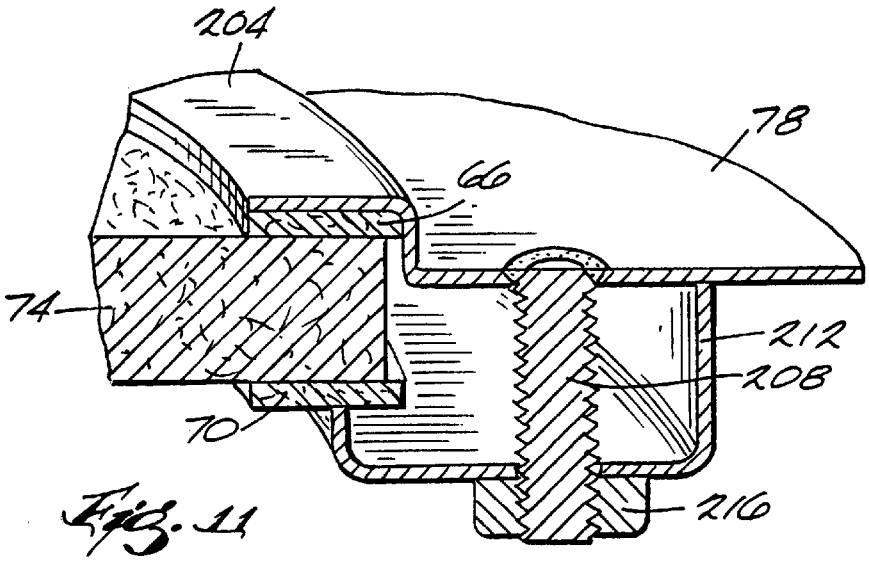
FIG. 11 is a cross-section view of a portion of the water heater shown in FIG. 10.

FIGS. 10 and 11 illustrate another alternative flame arrestor support 78, which includes a raised portion 204 surrounding the opening in which the flame arrestor 74 is positioned. Additionally, the retainer member 62 may be formed integrally with the flame arrestor support 78, as illustrated, or it may be welded or otherwise affixed to the underside of the flame arrestor support 78. Studs 208 or other suitable fasteners (e.g., bolts, screws, clips, etc.) are welded or otherwise affixed to the flame arrestor support 78. A mounting member 212 that is separate from the flame arrestor support 78 is mounted under the flame arrestor support 78 by threading nuts 216 onto the studs 208 to sandwich the flame arrestor 74 between the first and second flame arrestor seals 66, 70. The first flame arrestor seal 66 fits into the raised portion 204 in the flame arrestor support 78. In some cases, the threads of the studs 208 near the flame arrestor support 78 may be damaged during welding. The shape of the mounting member 212 provides a space between the nuts 216 and the flame arrestor support 78 to ensure that the threads that may have been damaged will not be needed. One advantage of this alternative design is that the flame arrestor 74 may be removed from under the combustion chamber 46 (e.g., through the air inlet 100, or by removing the base pan 12), instead of through the combustion chamber 46. It is believed that this may facilitate removal and replacement of flame arrestors 74 in the field.

Figure 13:
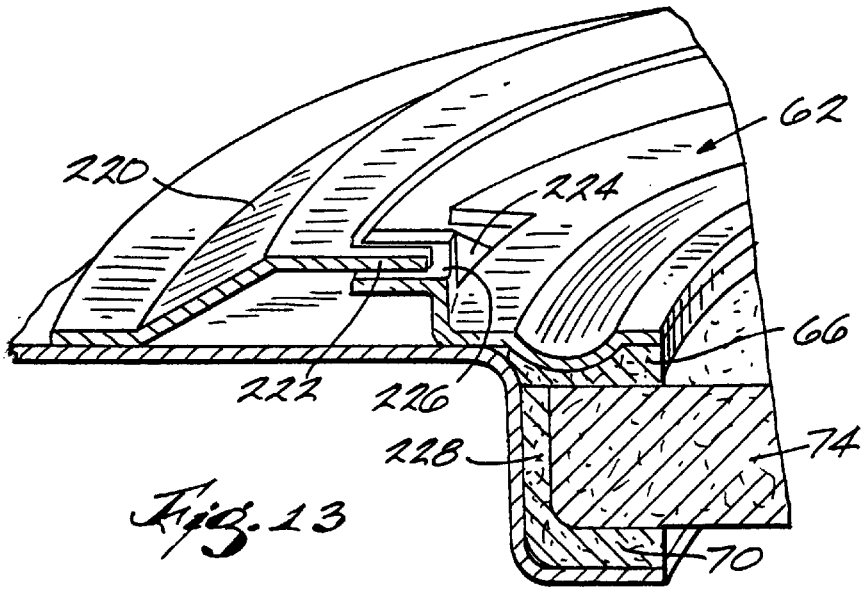
FIG. 13 is a cross-section view of a portion of the water heater shown in FIG. 12.
Figure 14:
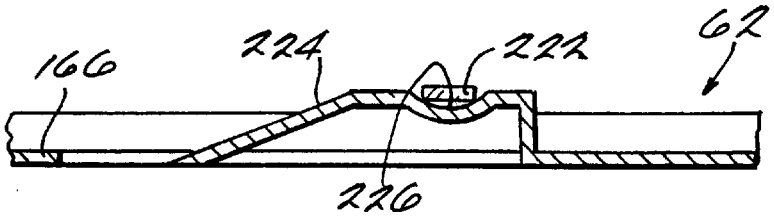
FIG. 14 is a cross-section view taken along line 14—14 in FIG. 12.
Figure 12:
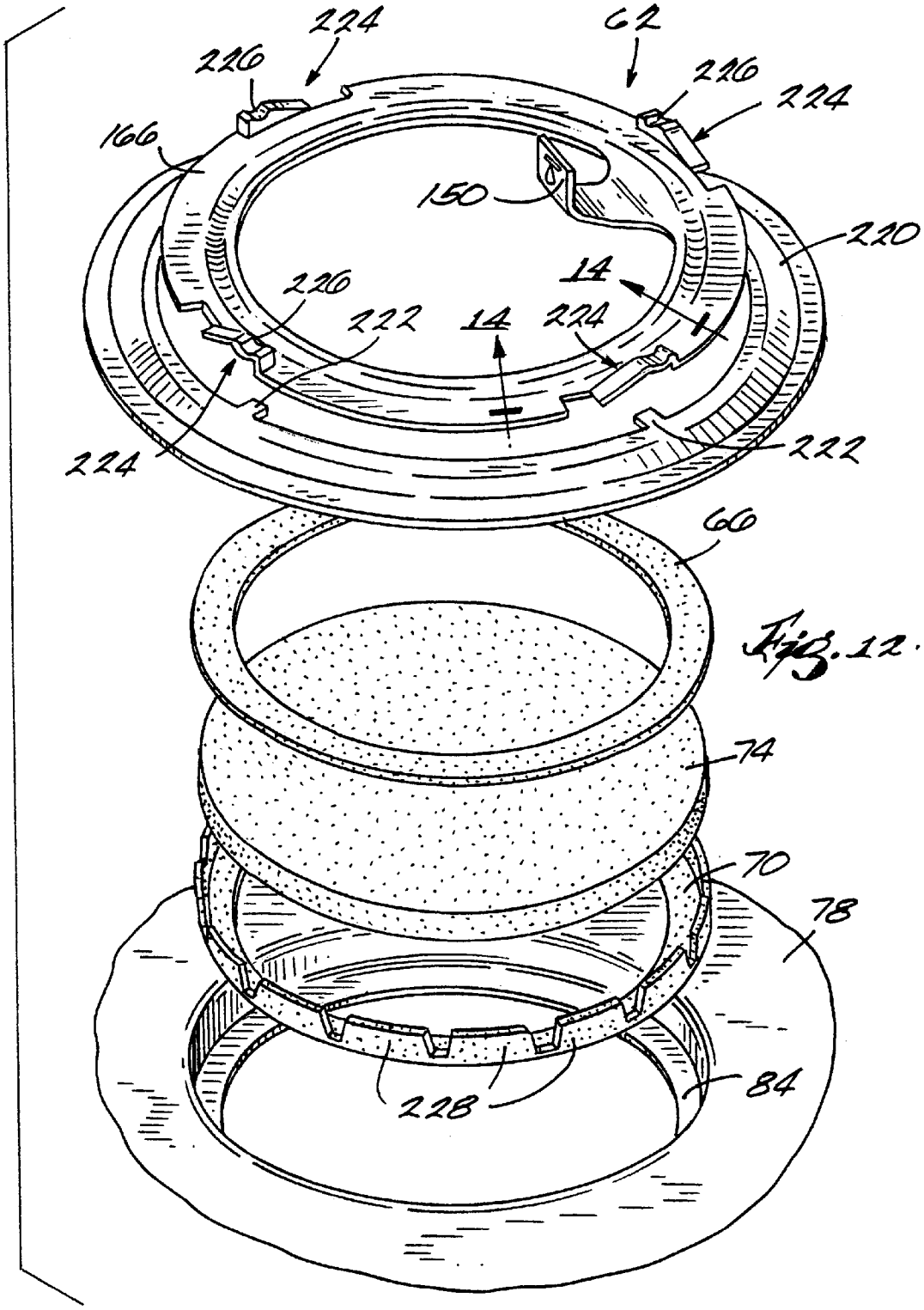
FIG. 12 is an exploded view of another alternative embodiment of the lower portion of the water heater.

FIGS. 12–14 illustrate a twist-on construction of the retainer member 62. In this embodiment, a ring 220 is affixed (e.g., by welding or with fasteners) to the top of the flame arrestor support 78, and extends into the combustion chamber 46. The inner diameter of the ring 220 is larger than the diameter of the flame arrestor 74 so that the flame arrestor 74 may be removed through the ring 220. The ring 220 includes a plurality of tabs 222 extending radially inwardly. The ring portion 166 of the retainer member 62 in this embodiment includes a plurality of ramps 224 corresponding to respective tabs 222. The retainer member 62 may be tightened down against the first flame arrestor seal 66 by rotating the retainer member 62 with respect to the ring 220, and causing the tabs 222 to ride up the ramps 224. In this regard, the ramps 224 act as cams, forcing the ring portion 166 of the retainer member 62 down to seal the flame arrestor 74. Flat or slightly concave portions 226 are provided at the top of the ramps 224 so that the tabs 222 will be held in the locked position and not slide back down the ramps 224 once the retainer member 62 has been set in place. The second flame arrestor seal 70 is illustrated as having optional vertical portions 228 to further ensure a quality seal. Alternatively, the ramps 224 may be formed integrally with the flame arrestor support 78, removing the need for the separate ring 220. In another alternative embodiment, the ramps 224 or tabs may be formed integrally with the flame arrestor 74.

In another alternative embodiment (not shown), the twist-on feature may be used to support the flame arrestor 74 under the flame arrestor support 78. In such a configuration, the ring portion 166 of the retainer member 62 may be permanently or releasably affixed to the top surface of the flame arrestor support 78, and either ramps or tabs may be provided on the bottom surface of the flame arrestor support 78. A mounting member having corresponding tabs or ramps can be mounted under the flame arrestor support 78 by rotating the mounting member with respect to the flame arrestor support 78. In this regard, the mounting member is forced up to seal the flame arrestor 74 by the cam action of the ramps and tabs.

FIG. 15 illustrates an alternative skirt 54 and flame arrestor support 78 combination. In this embodiment, the flame arrestor support 78 and skirt 54 are formed as one piece. The skirt 54 is made to have a draft angle $\alpha$ of less than about 10°, and preferably about 5° with respect to vertical so that the skirt 54 and flame arrestor support 78 combination can be stacked as shown during shipping and in inventory. A divider 234 is shown between adjacent flame arrestor supports 78 to prevent the upper piece from getting wedged inside the lower piece.

FIG. 16 illustrates an alternative base pan 12 having a plurality of air inlets 100 to provide additional air flow. Because the air inlets 100 are distributed around the base pan 12, the screens 102 may not require diverter tabs 106. Wind blowing across one of the air inlets 100 will merely draw more air in through another air inlet 100. This figure also illustrates a formed ring 238 being used instead of the dimples 98. The formed ring 238 may have a smooth curved shape, or may be pointed to minimize surface area contact with the support surface on which the water heater 10 sits.

What is claimed is:

1. A water heater comprising:

a water tank;

a combustion chamber/air plenum beneath the tank;

a gas burner in the combustion chamber/air plenum;

a flue extending upwardly from the combustion chamber/air plenum and through the water tank;

a jacket surrounding the water tank;

insulation between the water tank and the jacket; and a base pan including a generally horizontal bottom wall partially defining the combustion chamber/air plenum, the base pan also including a first step above and surrounding the bottom wall, the first step supporting the water tank, and a second step above and surrounding the first step, the second step supporting the insulation and the jacket.

2. The water heater of claim 1, wherein the bottom wall of the base pan includes integral feet for supporting the base pan on a supporting surface.

3. The water heater of claim 1, wherein the bottom wall of the base pan has formed integrally therewith one of a plurality of dimples and a formed ring for supporting the base pan.

4. The water heater of claim 1, further comprising a skirt supporting the water tank and partially defining the combustion chamber/air plenum, and wherein the first step supports the skirt.

5. The water heater of claim 1, wherein the base pan is made of stamped metal or plastic.

6. The water heater of claim 1, wherein the combustion chamber/air plenum is divided into an air plenum and a combustion chamber above the air plenum, and wherein the water heater further comprises a flame arrestor through which substantially all air must flow to pass from the air plenum to the combustion chamber.

7. The water heater of claim 6, wherein the base pan includes a side wall having therein an air inlet communicating with the air plenum, and wherein the water heater further comprises a screen covering the air inlet, the screen having a width and having thereon an outwardly extending projection which substantially prevents air flow across the width of the screen and which deflects air flowing across the screen into the air inlet.

8. The water heater of claim 7, wherein the projection is integral with the screen.

9. The water heater of claim 6, further comprising a generally horizontal plate separating the combustion chamber/air plenum into the combustion chamber and the air plenum, the plate being supported on the first step, having an upper surface, and having therein an opening in which the flame arrestor is located, and the water heater further comprising a retainer that is seated on the upper surface of the plate and that holds the flame arrestor in place.

10. The water heater of claim 9, further comprising a generally horizontal radiation shield above the plate, the radiation shield having therein an opening, and the retainer having a portion extending upwardly and through the opening in the radiation shield to hold the radiation shield in an operating position.

11. The water heater of claim 9, further comprising a burner manifold which communicates with the burner and which has an end, and wherein the retainer supports the end of the burner manifold.

12. The water heater of claim 11, further comprising a wall partially defining the combustion chamber, wherein the burner manifold extends through said wall, and a boot surrounding a portion of said burner manifold, and providing a substantially airtight seal between said wall and said burner manifold, said boot including a plurality of folds to permit movement of said burner manifold without breaking said substantially airtight seal.

13. The water heater of claim 11, further comprising a generally horizontal radiation shield above the plate, the radiation shield having therein an opening, and the retainer having a portion extending upwardly and through the opening in the radiation shield so as to hold the radiation shield in place, the portion also having therein an opening through which the end of the burner manifold extends.

14. The water heater of claim 1, further comprising a wall partially defining the combustion chamber/air plenum, the wall having therein an opening, a plurality of conduits extending through said wall, and a grommet disposed within said opening, said grommet having channels extending therethrough in a longitudinal direction, and respective slits connecting said channels to an outer surface of said grommet such that each of said conduits may be inserted into a respective channel from a radial direction via a respective slit.

* * * * *